US006092256A

United States Patent [19]

Chen

[11] Patent Number: 6,092,256

[45] Date of Patent: Jul. 25, 2000

[54] FLAT-BACK HAIRBRUSH

[76] Inventor: Kuo-Chin Chen, 2-1 Fl., No.18, Alley 47, Lane 208, Jui An Street, Ta An District, Taipei, Taiwan

[21] Appl. No.: 09/196,886

[22] Filed: Nov. 20, 1998

[51] Int. Cl.[7] ..... A46B 9/02

[52] U.S. Cl. ..... 15/186; 132/120; 132/313

[58] Field of Search ..... 15/186, 187, 188, 15/160, 176.1, 176.4, 176.5, 201, 202; 132/120, 148, 313

[56] References Cited

U.S. PATENT DOCUMENTS

| | | | |
|---|---|---|---|
| 2,795,807 | 6/1957 | Salvy | 15/187 |
| 2,963,729 | 12/1960 | Thonbo | 15/187 |
| 3,128,487 | 4/1964 | Vallis | 15/187 |
| 4,479,501 | 10/1984 | Chern | 15/186 |
| 5,345,646 | 9/1994 | Rothweiler | 15/187 |
| 5,509,378 | 4/1996 | Kimura | 15/186 |
| 5,600,865 | 2/1997 | Morrison | 15/169 |

FOREIGN PATENT DOCUMENTS 20037 11/1956 Germany .

*Primary Examiner*—Robert J. Warden, Sr.
*Assistant Examiner*—Kaj K. Olsen
*Attorney, Agent, or Firm*—Pro-Techotr International Services

[57] ABSTRACT

Disclosed is a flat-back hairbrush mainly including a flat back member and an elastic member attached to a stepped and raised top portion of the back member and having a plurality of brushing pins distributed thereon. The elastic member has a downward extended flange around its lower outer periphery to just firmly enclose an outer periphery of the raised top portion of the back member. The tight and flush fit as well as an adequate amount of glue applied between the flange portion of the elastic member and the raised top portion of the back member allows the back member and the elastic member to be easily and quickly assembled to form the hairbrush without causing deformation of the elastic member over the back member.

2 Claims, 10 Drawing Sheets

FLAT-BACK HAIRBRUSH

BACKGROUND OF THE INVENTION

The present invention relates to a flat-back hairbrush, and more particularly to a flat-back hairbrush having improved assembling structure.

FIG. 1 is an assembled sectional view of a conventional flat-back hairbrush that includes a back member 1 having an inward flange to define a recess 11 and an elastic member 2 set in the recess 11 and be retained in position by the inward flange of the back member 1. A plurality of brushing pins 3 penetrate through the elastic member 2 with their expanded rear heads 31 abutting against and retained to an inner bottom surface of the elastic member 2. Glue or other adhesive material is applied on outer periphery of the elastic member 2, so that the elastic member 2 is adhered along its edge to the inward flange of the back member 1 and firmly fixed in the recess 11. To ensure the firm location of the elastic member 2 in the recess 11, the elastic member 2 is usually designed to be suitably larger than an area defined by the inward flange around the recess 11. This makes the elastic member 2 to outward protrude at its central portion when it is squeezed and completely set in the recess 11. That is, the outward protruded central portion of the elastic member 2 prevents the rear expanded heads 31 of the brushing pins 3 abutting on the inner bottom surface of the elastic member 2 from being flush with the edge portion of the elastic member 2 glued to the inward flange of the back member 1. Following are disadvantages existing in the above-described conventional flat-back hairbrush:

1. It is uneasy to squeeze and set the elastic member 2 into the recess 11 and therefore the efficiency and cost of production of the hairbrush is adversely affected.
2. The brushing pins 3 locating at the centrally arched elastic member 2 tend to angularly project from the elastic member 2 in different directions and can not densely contact with a user's hairs.
3. Since the edge portion of the elastic member 2 is set below and glued to the inward flange of the recess 11, the brushing pins 3 are distributed on the elastic member 2 over an area smaller than the actual area of the elastic member 2 and the back member 1. That is, a part of the elastic member 2 and the back member 1 at the periphery thereof is unnecessarily wasted to increase the production cost while the hairbrush shall have an increased volume.
4. When the hairbrush has an angular shape as shown in FIGS. 2 and 3, irregular dents will appear on the elastic member 2 particularly at the angular portions to adversely affect the appearance of the hairbrush. Moreover, brushing pins 3 at these deformed areas will irregularly inclined to cause discomfort during brushing hairs.

It is therefore tried by the inventor to develop a flat-back hairbrush that has improved structure to allow easier and quicker assembling and high efficient utilization of the entire area of the elastic member of the hairbrush while there is no limitation in the shape of the hairbrush.

SUMMARY OF THE INVENTION

A primary object of the present invention is to provide a flat-back hairbrush including a back member and an elastic member for fixing brushing pins that may be easily and quickly assembled to reduce production cost.

Another object of the present invention is to provide a flat-back hairbrush including an elastic member that can be completely flatly attached to a back member, so that the elastic member can be highly efficiently utilized for mounting the brushing pins.

A further object of the present invention is to provide a flat-back hairbrush having an assembling structure that will not cause any limitation in the design of the hairbrush shapes.

To achieve the above and other objects, the flat-back hairbrush according to the present invention mainly includes a flat back member and an elastic member attached to a stepped and raised top portion of the back member and having a plurality of brushing pins distributed thereon. The elastic member has a downward extended flange around its lower outer periphery to just firmly enclose an outer periphery of the raised top portion of the back member. The tight and flush fit as well as an adequate amount of glue applied between the flange portion of the elastic member and the raised top portion of the back member allows the back member and the elastic member to be easily and quickly assembled to form the hairbrush without causing deformation of the elastic member over the back member.

BRIEF DESCRIPTION OF THE DRAWINGS

The objects, features, and performance of the present invention may be best understood by referring to the following detailed description of the preferred embodiments and the accompanying drawings, wherein.

DETAILED DESCRIPTION OF THE PREFERRED EMBODIMENTS

Figure 1:
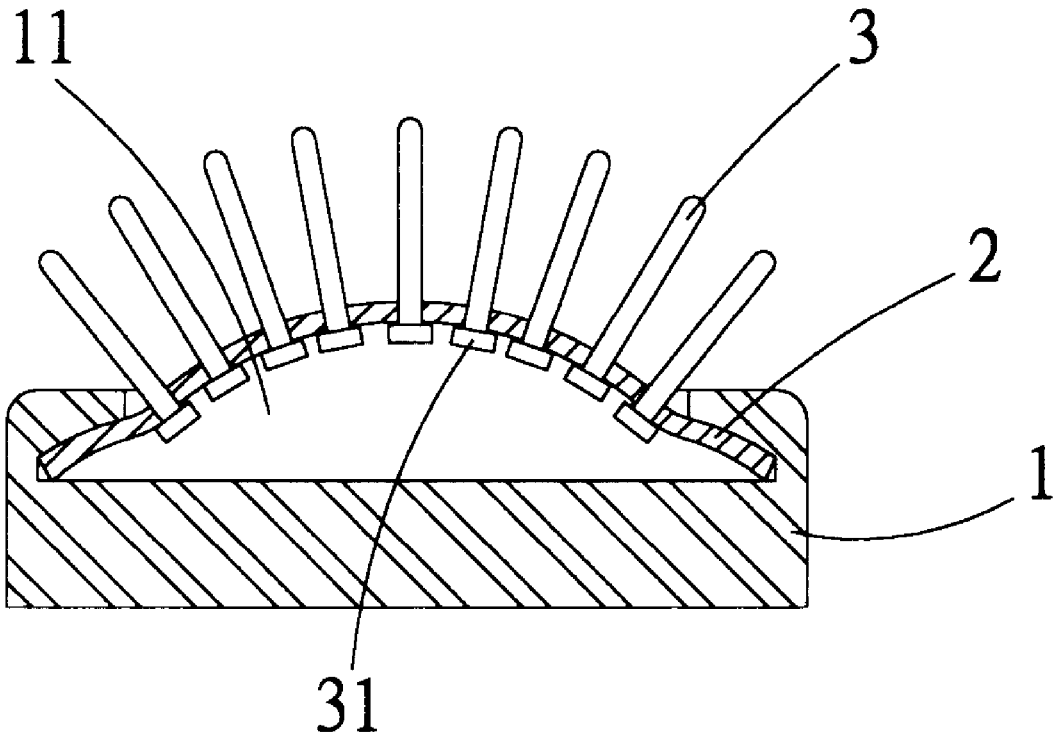
(PRIOR ART) FIG. 1
FIG. 1 is an assembled sectional view showing the structure of a conventional flat-back hairbrush.
Figure 2:
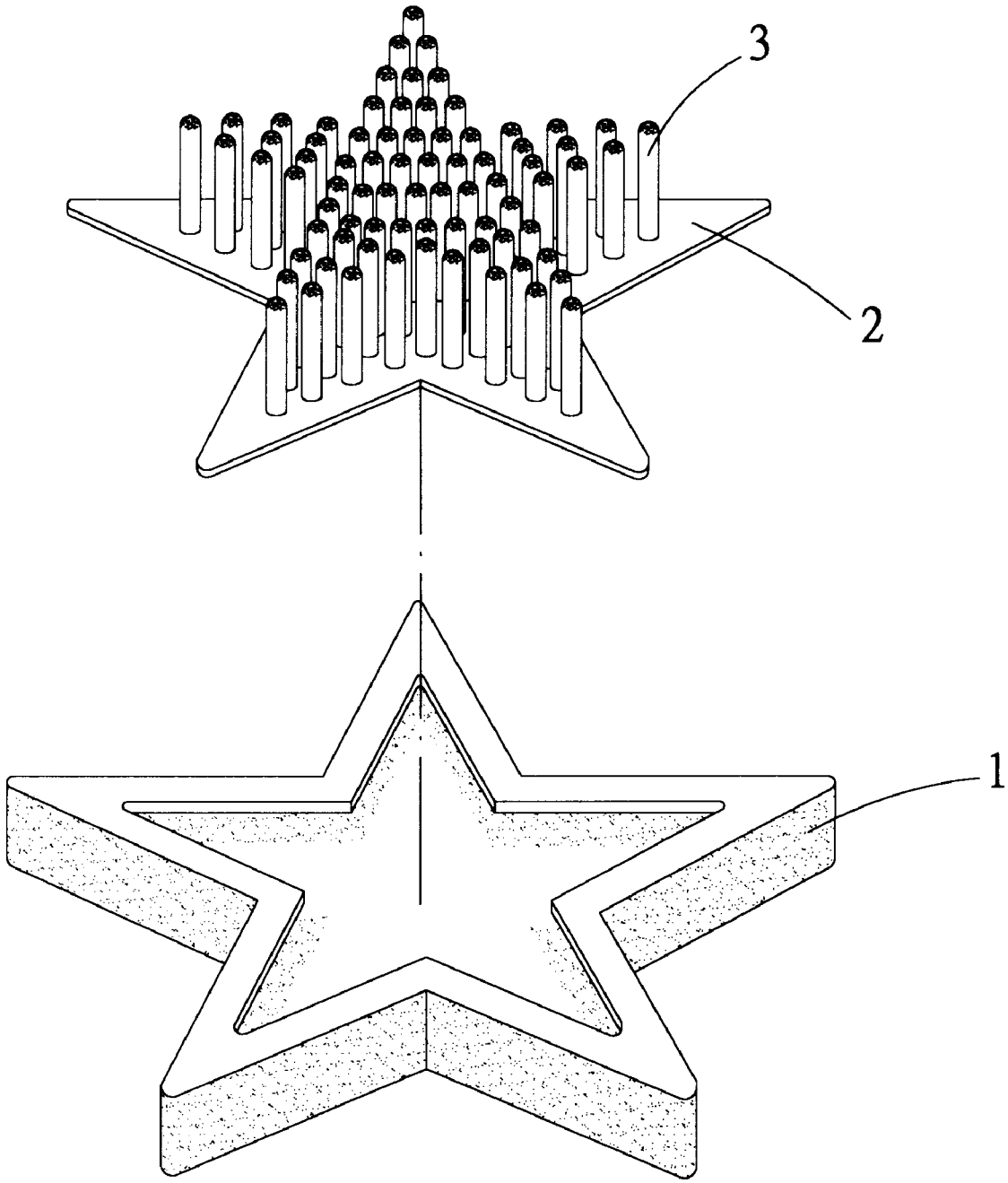
(PRIOR ART) FIG.2
FIG. 2 is an exploded perspective view showing the assembling of different parts of the conventional flat-back hairbrush.
Figure 3:
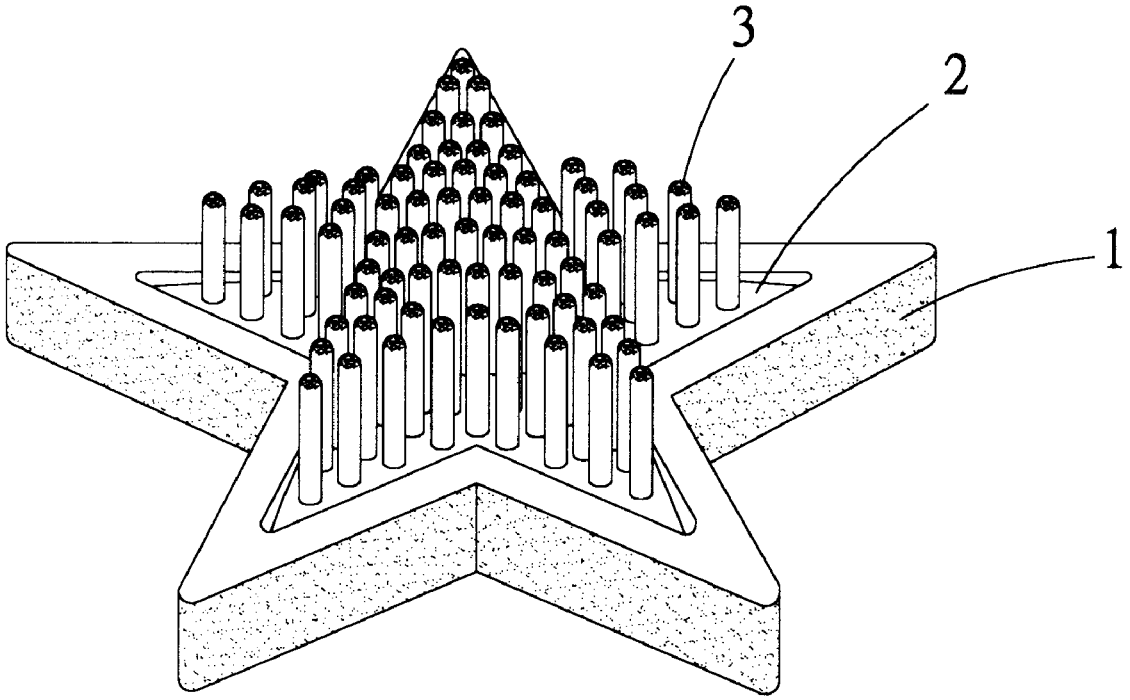
(PRIOR ART) FIG.3
FIG. 3 is an assembled perspective view of the conventional hairbrush of FIG. 2.
Figure 4:
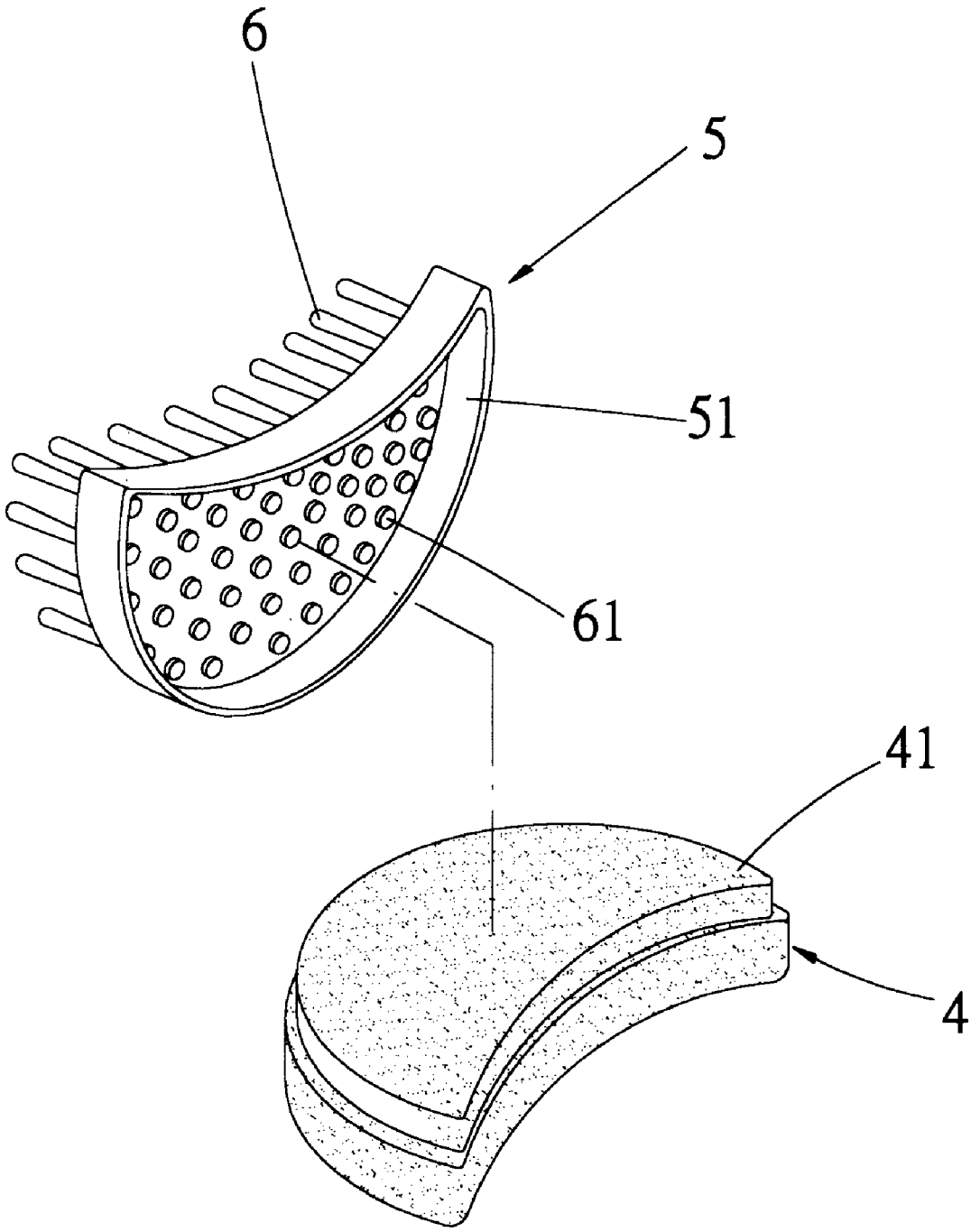
FIG. 4 is an exploded perspective view of a flat-back hairbrush according to an embodiment of the present invention.
Figure 5:
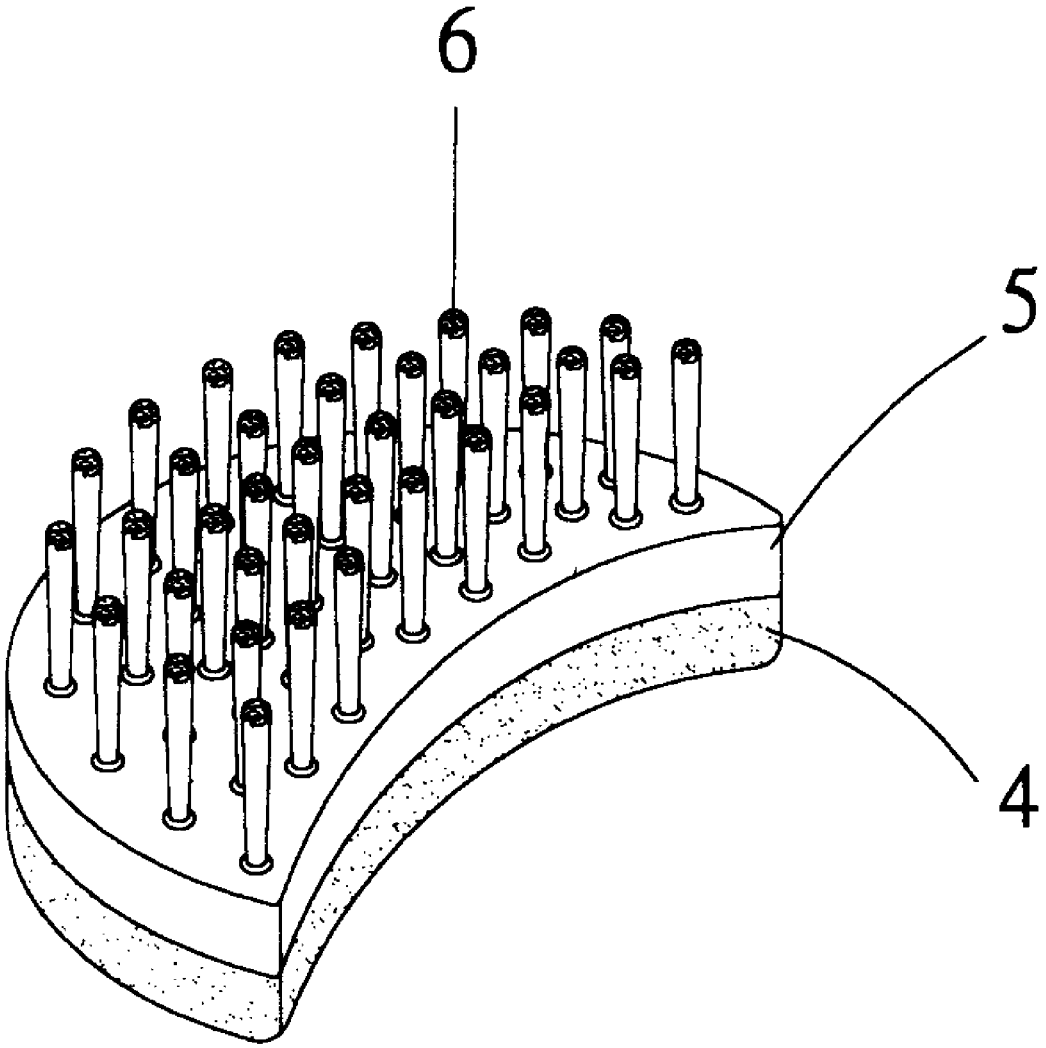
FIG. 5 is an assembled perspective view of the flat-back airbrush of FIG. 4.

Please refer to FIGS. 4 and 5 that are exploded and assembled perspectives, respectively, of a flat-back hairbrush according to an embodiment of the present invention. As shown, the flat-back hairbrush mainly includes a flat back member 4, an elastic member 5, and a plurality of brushing pin members 6. Each of the pins 6 has an expanded head portion 61, such that pins 6 can be fixed on the elastic member 5 in a predetermined pattern by inserting them upward through the elastic member 5 with the expanded head portions 61 pressing against an inner bottom side of the elastic member 5.

Figure 6:
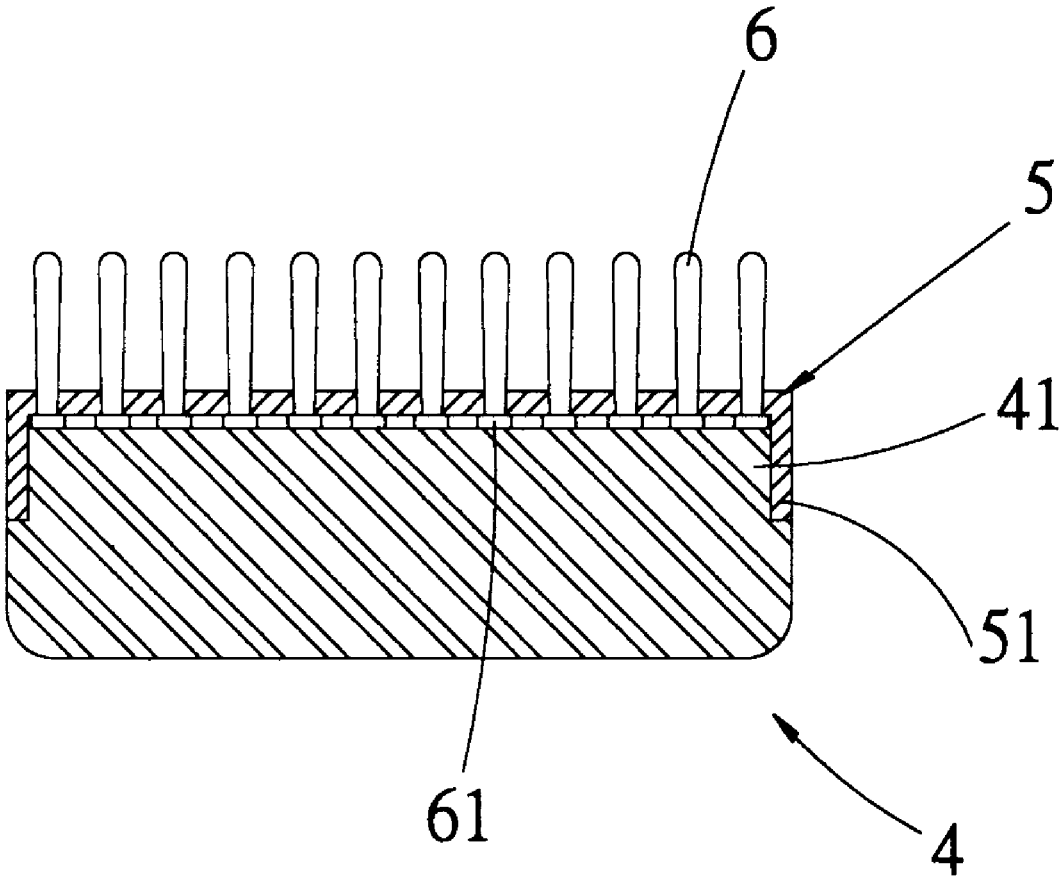
FIG. 6 is an assembled sectional view of the flat-back hairbrush of FIG. 5.

The flat back member 4 has an inward reduced and therefore stepped upper outer periphery, so that a raised top portion 41 having the same contour as that of the back member 4 is formed above the back member 4. The elastic member 5 has a downward extended flange portion 51 that extends around a whole outer periphery of the elastic member 5. The flange portion 51 has a contour corresponding to that of the back member 4 and has a thickness corresponding to the inward reduced distance of the upper outer periphery of the back member 4. The flange portion 51 of the elastic member 5 further has a height equal to a total distance of a height of the raised top portion 41 of the back member 4 and a height of the expanded head portion 61 of the pin 6. Whereby, the elastic member 5 can be assembled to the back member 4 simply by setting the flange portion 51 around the outer periphery of the raised top portion 41, as shown in FIG. 6. Glue or other adhesive material maybe applied on both a top surface of the raised top portion 41 and the inner bottom side of the elastic member 5 to ensure firm attachment of the elastic member 5 to the back member 4. At this point, all the expanded head portions 61 of the pins 6 tightly abut on the top surface of the raised top portion 41 of the back member 4.

Figure 7:
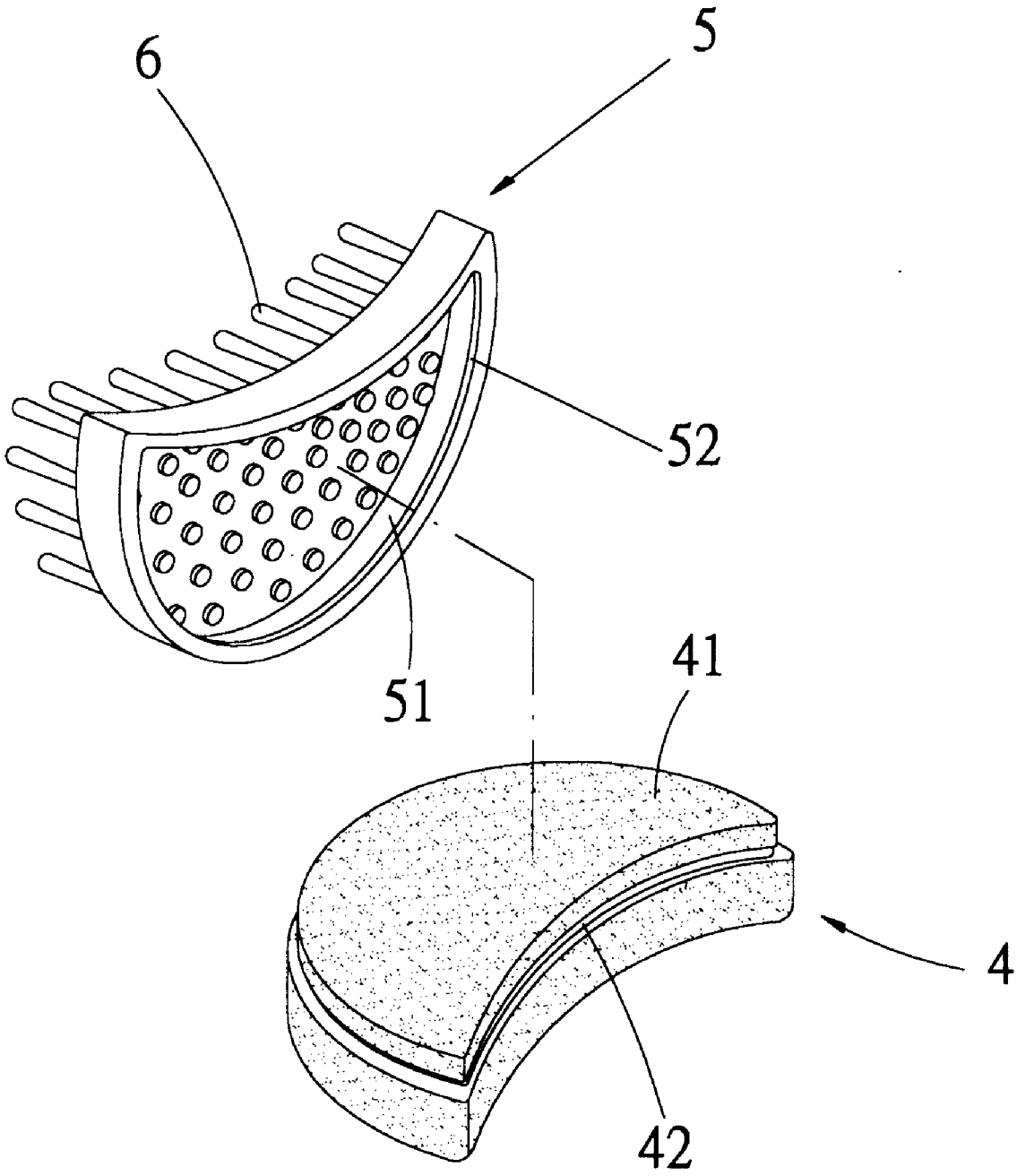
FIG. 7 is an exploded perspective of a flat-back hairbrush similar to that of FIG. 4 but with enhanced assembling structure.
Figure 8:
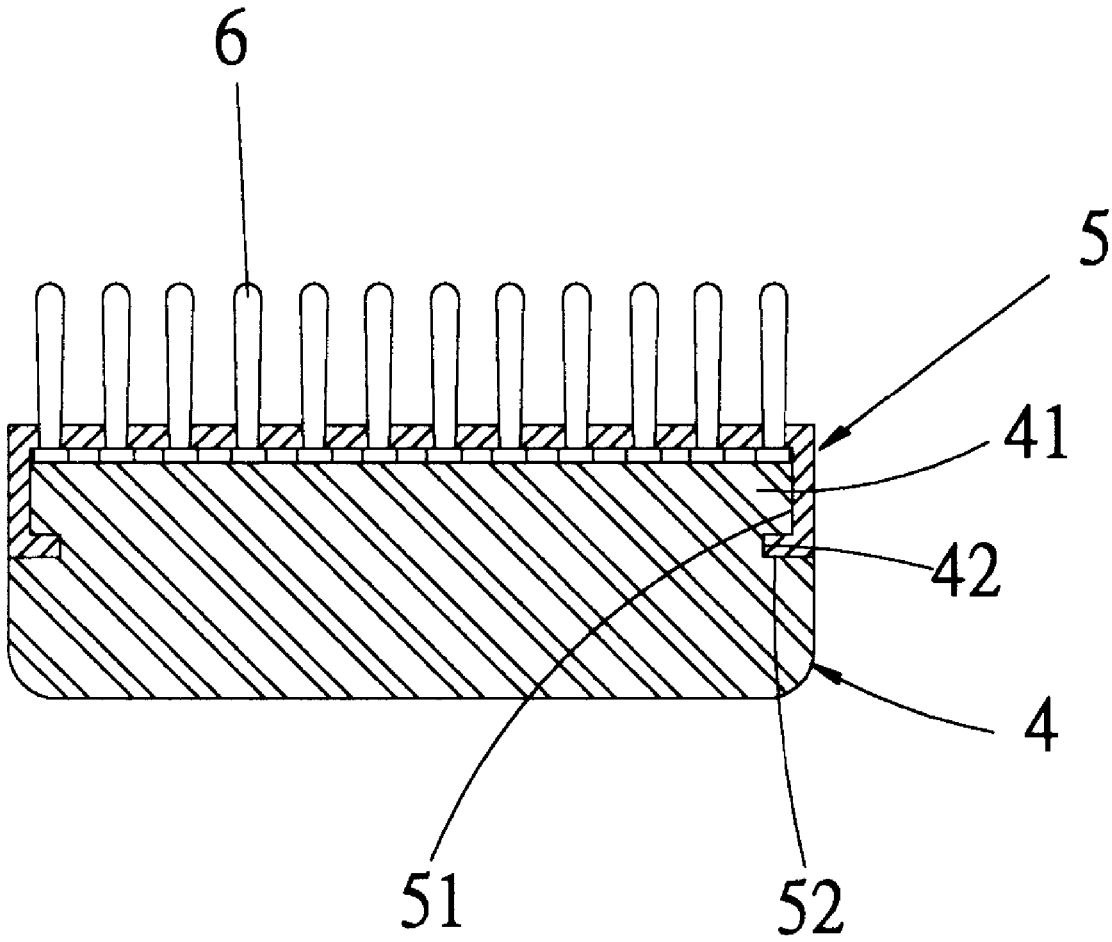
FIG. 8 is an assembled sectional view of the hairbrush of FIG. 7.

FIGS. 7 and 8 are exploded perspective and assembled sectional views, respectively, of another embodiment of the flat-back hairbrush of the present invention. In this embodiment, an inward dented groove 42 is formed along a lower outer periphery of the raised top portion 41 of the back member 4, and a lower edge of the flange portion 51 of the elastic member 5 turns radially inward to form a second inward flange portion 52 that just fitly engages into the groove 42 to further ensure firm and tight connection of the elastic member 5 to the back member 4.

Figure 9:
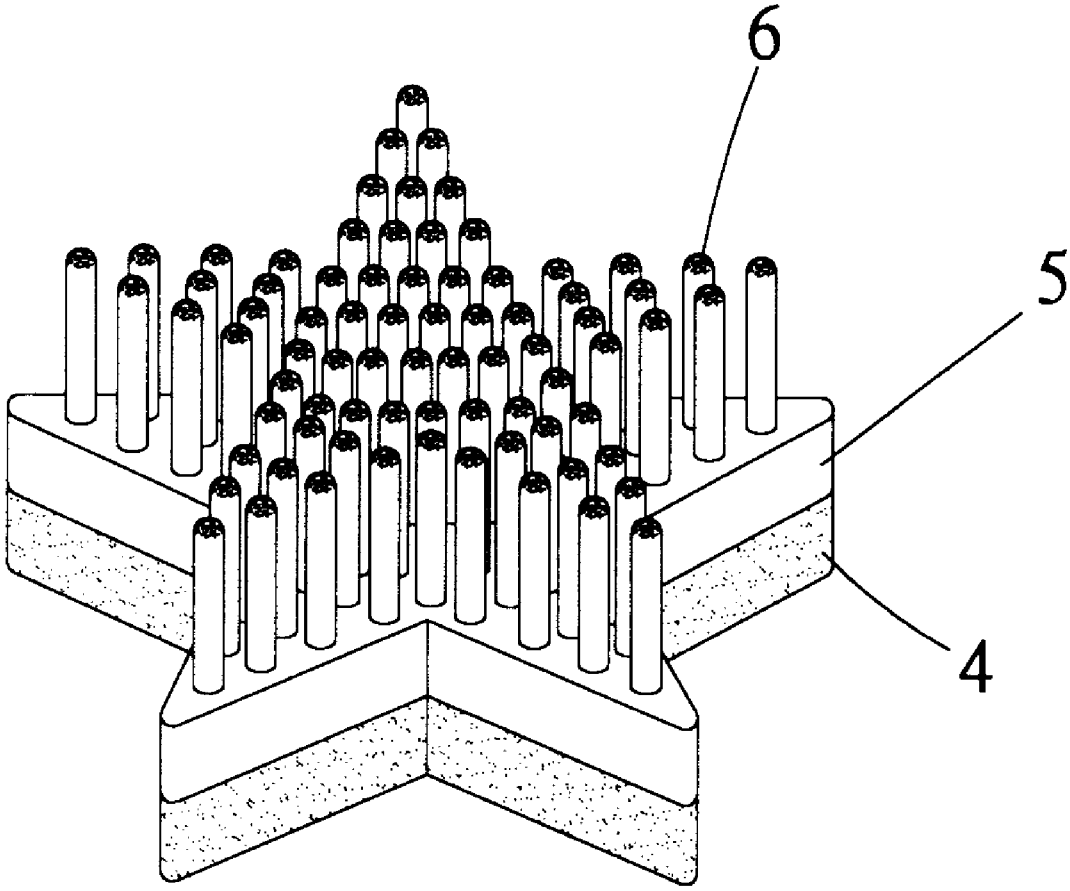
FIG. 9 illustrates a star-shaped flat-back hairbrush according to the present invention.
Figure 10:
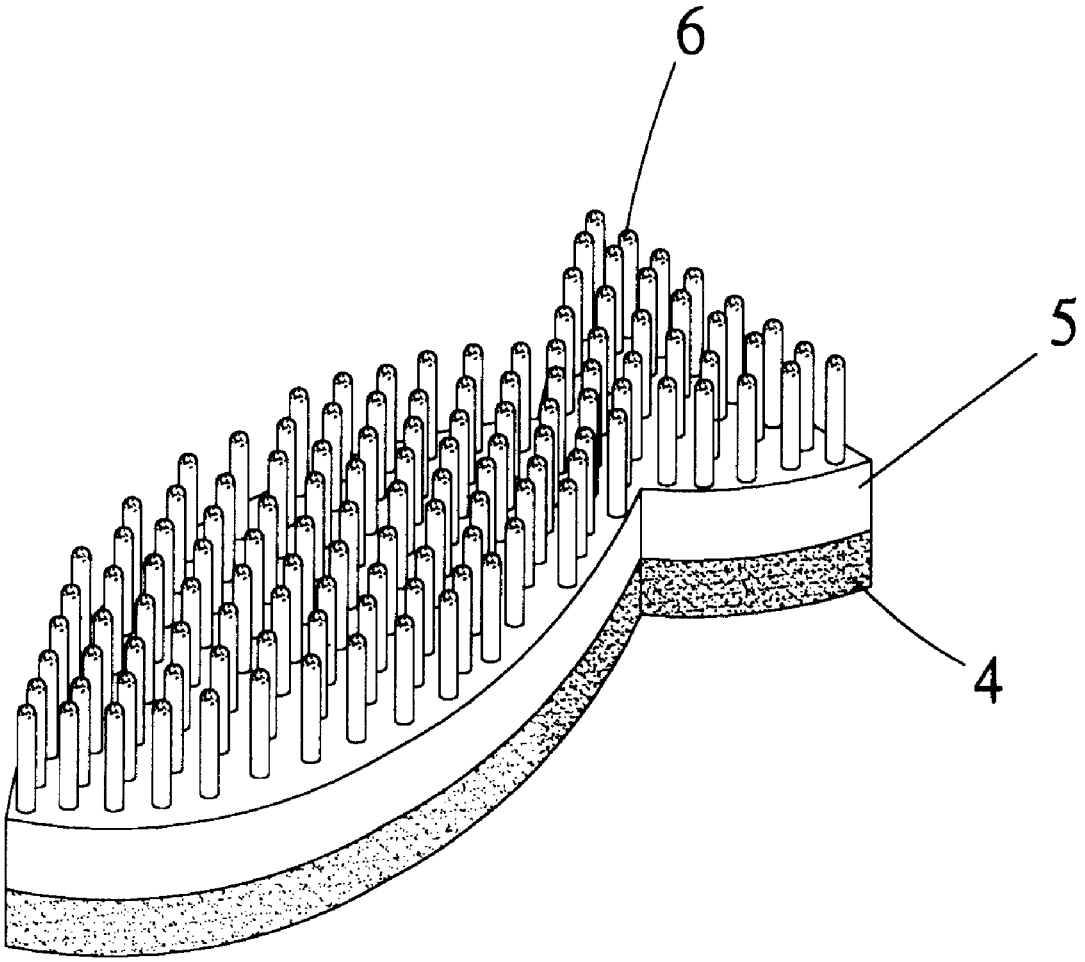
FIG. 10 illustrates a fish-shaped flat-back hairbrush according to the present invention.

With the flange portions 51, 52 of the elastic member 5 and the dimensionally corresponding inward reduced top portion 41 and the groove 42 on the back member 4, it is possible for the elastic member 5 to flatly attached to the top portion 41 of the back member 4 even the members 4 and 5 are in complicate angular shapes, such as the star shape shown in FIG. 9 and the fish shape shown in FIG. 10.

Following are advantages of the flat-back hairbrushes according to the present invention:

1. The elastic member 5 can be easily assembled to the back member 4 to allow high efficient production.
2. The elastic member 5 assembled to the back member 4 maintains in flat for the expanded pin heads 61 of all pins 6 to press against a flat top surface of the raised portion 41 of the back member 4. This allows a denser contact of pins 6 with the user's hairs than a conventional centrally protruded hairbrush could do.
3. The elastic member 5 is assembled to the back member 4 by firmly enclosing its flange portion 51 around the outer periphery of the raised top portion 41 of the back member 4. This allows the area on the elastic member 5 occupied the pins 6 to be as large as the area of the back member 4. In other words, when the numbers of pins 6 to be fixed on the elastic member 5 are previously decided, the back member 4 may be designed to correspond to the numbers of pins 6. This avoids unnecessary waste of material for the back member 4 to minimize the production cost of the hairbrush.
4. When the back member 4 and the elastic member 5 are designed to have corresponding angular shapes as those shown in FIGS. 9 and 10, they can still be ideally assembled in the same manner as that for other shapes.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A flat-back hairbrush comprising:

a back member, an elastic member, and a plurality of brushing pins, said brushing pins extend upward through said elastic member and mounted thereon; said elastic member having a flange portion extended downward from an outer periphery thereof, and said back member having a stepped upper outer periphery to define a raised top portion of said back member, said raised top portion of said back member having a flat upper surface that supports said elastic member with said brushing pins extended therethrough; whereby said elastic member can be easily attached to and around said back member by engaging said flange portion of said elastic member around said raised top portion of said back member and by applying adhesive material between said flange portion and said raised top portion.

2. The flat-back hairbrush as claimed in claim 1, wherein:

said raised top portion of said back member has an inward dented groove formed around a lower outer periphery thereof, and said flange portion of said elastic member having a lower edge turning radially inward to form a second flange portion that engages said inward dented groove of said raised top portion to further secure said elastic member to said back member.

* * * * *